US010300504B2

(12) United States Patent
Fehr et al.

(10) Patent No.: US 10,300,504 B2
(45) Date of Patent: May 28, 2019

(54) SPRAY SYSTEM PUMP WASH SEQUENCE

(71) Applicant: Graco Minnesota Inc., Minneapolis, MN (US)

(72) Inventors: David L. Fehr, Champlin, MN (US); Dennis J. Van Keulen, Rogers, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 15/886,613

(22) Filed: Feb. 1, 2018

(65) Prior Publication Data

US 2018/0154388 A1 Jun. 7, 2018

Related U.S. Application Data

(63) Continuation-in-part of application No. 14/904,655, filed as application No. PCT/US2014/047198 on Jul. 18, 2014, now Pat. No. 9,901,945.

(Continued)

(51) Int. Cl.
*B05B 15/00* (2018.01)
*B05B 15/55* (2018.01)

(Continued)

(52) U.S. Cl.
CPC ..... *B05B 15/557* (2018.02); *B05B 9/0406* (2013.01); *B05B 9/0413* (2013.01);

(Continued)

(58) Field of Classification Search
CPC ..... B05B 7/04; B05B 7/24; B05B 7/1254; B05B 9/0413; B05B 12/087;

(Continued)

(56) References Cited

U.S. PATENT DOCUMENTS 2,946,488 A * 7/1960 Kraft ..... B01F 15/0475 222/134
3,674,205 A * 7/1972 Kock ..... B05B 12/14 137/240

(Continued)

FOREIGN PATENT DOCUMENTS

CN 101175576 A 5/2008
JP H0810684 A 1/1996

(Continued)

OTHER PUBLICATIONS

International Search Report and Written Opinion from PCT Application Serial No. PCT/US2014/047198, dated Nov. 11, 2014, 11 pages.

(Continued)

*Primary Examiner* — Viet Le
(74) *Attorney, Agent, or Firm* — Kinney & Lange, P.A.

(57) ABSTRACT

A method for a system having a plurality of primary fluid sources and a fluid output with a common pump includes halting pumping of a first fluid, isolating the common pump from the fluid output and the primary fluid sources, connecting an inlet of the common pump to a solvent source and a compressed air source, and an outlet of the common pump to a waste fluid dump, filling the common pump with a first purge volume of solvent, cycling the common pump in a flush mode, operating the common pump in a timed flow mode, and connecting an inlet of the common pump to a second primary fluid source, and an outlet of the common pump to the output line, and starting pumping of a second fluid from the second primary fluid source through the output line.

15 Claims, 7 Drawing Sheets

Related U.S. Application Data

(60) Provisional application No. 61/856,104, filed on Jul. 19, 2013.

(51) Int. Cl.
*B05B 9/04* (2006.01)
*B05B 12/14* (2006.01)
*B05B 7/12* (2006.01)

(52) U.S. Cl.
CPC ..... *B05B 12/149* (2013.01); *B05B 12/1418* (2013.01); *B05B 7/1254* (2013.01)

(58) Field of Classification Search
CPC . B05B 12/1418; B05B 12/149; B05B 15/025; F04B 13/00; F04B 15/02; F04B 17/03; F04B 19/22; F04B 23/06; F04B 39/10; F04B 49/10; F04B 49/22; F04B 51/00; F04B 53/10; F04B 53/14; F04B 53/16
USPC ..... 239/104, 106, 110, 112, 113, 120
See application file for complete search history.

(56) References Cited

U.S. PATENT DOCUMENTS 4,375,865 A * 3/1983 Springer ..... B05B 12/14 118/302
4,487,367 A * 12/1984 Perry ..... B05B 12/14 239/112
4,509,684 A * 4/1985 Schowiak ..... B05B 12/14 239/112
4,592,305 A * 6/1986 Scharfenberger ..... B05B 5/16 118/302
4,723,712 A * 2/1988 Egli ..... B01F 13/1055 137/240
4,728,034 A * 3/1988 Matsumura ..... B05B 5/16 239/112
4,792,092 A * 12/1988 Elberson ..... B05B 5/1633 239/112
4,848,384 A * 7/1989 Christopher ..... B60S 3/044 134/57 R
4,915,599 A * 4/1990 Katsuyama ..... B05B 7/24 222/135
4,932,589 A * 6/1990 Diana ..... B05B 5/1625 118/302
4,993,353 A * 2/1991 Ogasawara ..... B05B 12/14 118/302
5,102,045 A * 4/1992 Diana ..... B05B 12/14 118/302
5,102,046 A * 4/1992 Diana ..... B05B 12/14 239/112
5,306,350 A * 4/1994 Hoy ..... B05B 7/32 134/11
5,306,528 A * 4/1994 Bruehs ..... G03C 1/74 118/302
5,330,101 A * 7/1994 Turner ..... B05B 12/14 427/96.4
5,389,149 A * 2/1995 Carey ..... B05B 12/122 118/302
5,501,397 A * 3/1996 Holt ..... B05B 7/2486 239/124
5,571,562 A * 11/1996 Wakat ..... B05B 7/066 118/315
5,574,562 A 11/1996 Fishman et al.
5,647,542 A * 7/1997 Diana ..... B05B 5/1641 118/688
5,647,910 A * 7/1997 Brown ..... B05B 7/1254 118/710
5,660,201 A * 8/1997 Turner ..... B05B 12/04 134/169 C
5,776,249 A * 7/1998 Rutz ..... B05B 7/1404 118/300
5,803,109 A * 9/1998 Rosen ..... B05B 15/55 137/15.05
5,851,292 A * 12/1998 Minoura ..... B05B 5/1625 118/629
6,112,999 A * 9/2000 Fingleton ..... B05B 7/1404 239/112
6,116,261 A * 9/2000 Rosen ..... B01F 5/0256 137/15.04
6,423,152 B1 7/2002 Landaas
6,554,204 B1 * 4/2003 Nguyen ..... B05B 15/55 239/112
6,695,220 B2 * 2/2004 Vollmer ..... B05B 7/1404 239/305
6,705,545 B1 * 3/2004 Sroka ..... B05B 7/1404 239/112
6,840,404 B1 * 1/2005 Schultz ..... B01F 15/0466 222/137
6,918,551 B2 * 7/2005 Baltz ..... B05B 12/1418 118/629
7,954,673 B2 * 6/2011 Kosmyna ..... B05B 7/0408 137/240
8,317,493 B2 * 11/2012 Laessle ..... F04B 13/02 222/135
8,642,114 B2 * 2/2014 Bitterich ..... B41F 35/00 427/256
8,708,202 B2 * 4/2014 Robertson ..... B05B 7/2494 222/400.7
8,905,074 B2 * 12/2014 Cobb ..... F16K 51/02 137/599.06
9,359,748 B1 * 6/2016 Lamy ..... E03C 1/046
2002/0043280 A1 * 4/2002 Ochiai ..... B05B 7/0408 137/1
2003/0066905 A1 * 4/2003 Huffman ..... B05B 7/1673 239/135
2003/0190411 A1 * 10/2003 Donatti ..... B05B 7/0815 427/133
2005/0035226 A1 * 2/2005 Schebesta ..... B05B 7/0416 239/551
2007/0095938 A1 * 5/2007 Rioux ..... B01F 7/00133 239/302
2008/0210262 A1 * 9/2008 Lauzon ..... A47J 31/60 134/22.12
2009/0112255 A1 * 4/2009 Leopold ..... A61B 17/00491 606/214
2009/0202731 A1 * 8/2009 Kazkaz ..... B05B 5/1633 427/421.1
2010/0308134 A1 * 12/2010 Bunnell ..... B05B 7/0408 239/398
2016/0146201 A1 * 5/2016 Van Keulen ..... F16N 7/32 222/333
2016/0151798 A1 * 6/2016 Van Keulen ..... B05B 15/55 239/407
2016/0153441 A1 * 6/2016 Fehr ..... B05B 15/55 73/168
2016/0158784 A1 * 6/2016 Fehr ..... B05B 15/55 239/1
2016/0167066 A1 * 6/2016 Fehr ..... B05B 15/55 239/11
2016/0167076 A1 * 6/2016 Fehr ..... B05B 15/55 239/104

FOREIGN PATENT DOCUMENTS

JP H1176906 A 3/1999
JP 2004209379 A 7/2004
JP 2007167809 A 7/2007

OTHER PUBLICATIONS

Extended European Search Report for EP Application No. 14825826.2, dated Mar. 16, 2017, 9 pages.
Office Action from TW Application No. 103120513, dated Oct. 25, 2017, 16 pages.
Third Office Action from Chinese Patent Application No. 2014800392241, dated Jul. 27, 2018, 16 pages.

(56) References Cited

OTHER PUBLICATIONS

C. Zhan et al., "Mechanical Parts and Construction Machinery, the 3rd Edition", Feb. 2006, 3 pages.

* cited by examiner

SPRAY SYSTEM PUMP WASH SEQUENCE

CROSS-REFERENCE TO RELATED APPLICATION(S)

This application is a continuation-in-part of U.S. application Ser. No. 14/904,655, filed Jan. 12, 2016 for "Spray System Pump Wash Sequence" by D. Fehr and D. Van Keulen, which in turn claims the benefit of PCT Application No. PCT/US2014/047198, filed Jul. 18, 2014 for "Spray System Pump Wash Sequence" by D. Fehr and D. Van Keulen, which claims benefit of U.S. Provisional Application No. 61/856,104 filed Jul. 19, 2013 for "Spray System Pump Wash Sequence" by D. Fehr and D. Van Keulen.

BACKGROUND

The present invention relates generally to applicator systems that are used to spray fluids, such as paint, sealants, coatings, and the like. More particularly, the invention relates to a wash sequence for transitioning between spray fluids using a single common pump.

Fluid spray systems are used in a wide range of applications, including painting, glue application, and foam spraying. Some fluid applicators have separate "A-side" and "B-side" fluid systems (e.g. pumps, reservoirs, and fluid lines) that carry different fluids components, while others pump and spray only a single spray material. Common materials pumped in spray systems include paints, polyurethanes, isocyanates, polyesters, epoxies, and acrylics.

In some applications, it may be necessary or desirable to spray a variety of different materials (e.g. several different paints) with one spraying system. In such cases, the spraying system must ordinarily be thoroughly washed to avoid cross-contamination of different spray fluids, and reconnected to a new fluid source.

SUMMARY

A method for a system having a plurality of primary fluid sources and a fluid output with a common pump includes halting pumping of a first fluid, isolating the common pump from the fluid output and the primary fluid sources, connecting an inlet of the common pump to a solvent source and a compressed air source, and an outlet of the common pump to a waste fluid dump, filling the common pump with a first purge volume of solvent, cycling the common pump in a flush mode, operating the common pump in a timed flow mode, and connecting an inlet of the common pump to a second primary fluid source, and an outlet of the common pump to the output line, and starting pumping of a second fluid from the second primary fluid source through the output line.

A spray system includes a solvent source, a compressed air source, a waste fluid dump, a pump, a controller, valved inlet and outlet manifolds, and first and second fluid sources and sprayers for a first and second spray fluids, respectively. The solvent source supplies a washing solvent and the compressed air source provides an air stream. The pump includes a metered double-action pumping cylinder with a reciprocating plunger, and first and second inlet and outlet valves. The valved inlet manifold selectively couples the pump to the first and second fluid sources, the solvent source, and the compressed air source, while the valved outlet manifold selectively couples the pump to a fluid output and the waste fluid dump. The controller is configured to control the pump to spray the first fluid during a first operational state and the second fluid in a second operational state, and to transition from the first operational state to the second operational state via an intermediate washing process. In the intermediate washing process, the valved inlet manifold connects the pump to the solvent source and the compressed air source, and the valved outlet manifold connects the pump to the waste fluid dump, and the pump is actuated first in a pumping mode to flush the first fluid from the pump, then in a timed flow mode to direct washing solvent and compressed air through the pump.

DETAILED DESCRIPTION

The present invention is a system and method for washing a common spray pump shared by multiple spray fluids, as a means of transitioning from spraying one fluid to another.

Figure 1:
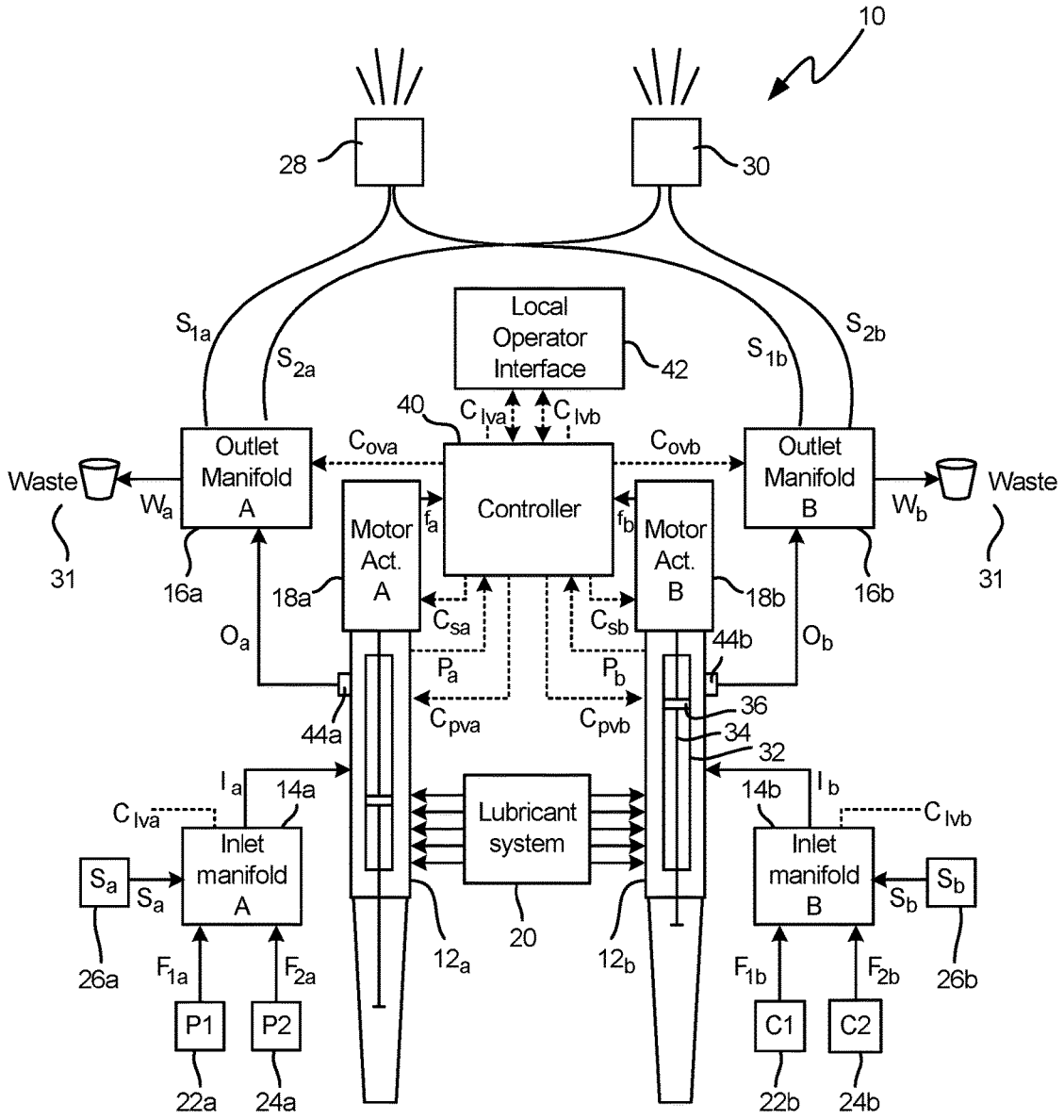
FIG. 1 is a schematic view of a spray system

FIG. 1 is a schematic diagram of spray system 10, a two-side spray system with an A-side and a B-side configured to carry separate fluid components that are only combined when sprayed. Spray system 10 can, for example, combine an A-side paint with a B-side catalyst (e.g. a polyurethane, acrylic, polyester, or epoxy) at the moment of spraying. Although spray system 10 will be discussed hereinafter primarily as a system for spraying paint, the present invention can analogously be applied to sprayers for foam, adhesive, and other materials. Many components of spray system 10 are present in parallel on both A- and B-sides of the system. For clarity, A-side components are labeled with an "a" subscript, while B-side components are labeled with a "b" subscript. Hereinafter, reference numbers without subscript will be used to refer generically to elements found in parallel on both A- and B-sides of spray system 10, and to single elements common to both sides, while particular A- or B-side counterparts will be denoted with "a" or "b" subscripts, as appropriate. "Pump 12*a*" and "pump 12*b*," for example, are specific elements of the A- and B-side subsystems of spray system, respectively. Description related to "pump 12" (without subscript) refers generically to pump.

Spray system 10 includes A- and B-side pumps 12 that pump fluid from inlet manifolds 14 via inlet lines $I_a$ and $I_b$ to outlet manifolds 16 via outlet lines $O_a$ and $O_b$. In the depicted embodiment, pumps 12 are double-action reciprocating cylinder pumps driven by motorized actuators 18, with seals lubricated by lubricant system 20. Motorized actuators 18 can, for example, be linear DC step motors. Lubricant system 20 includes at least one lubricant reservoir and fluid routing lines suited to carry lubricant from lubricant system 20 to valve seals and other throat seals of pumps 12. Although lubricant system 20 is illustrated as a unitary system, some embodiments of spray system 10 can use separate A- and B-side lubricant systems, e.g with different lubricants.

Inlet and outlet manifolds 14 and 16, respectively, are valved manifolds that selectively couple pumps 12 to a plurality of fluid sources and outputs. Inlet and outlet manifolds 14 and 16 allow spray system 10 to switch between a plurality of connected fluids without any need to disconnect or reconnect fluid lines. Although each outlet manifold 16 is depicted with three outlets and each inlet manifold 14 is depicted with three inlets, any number of inlets and outlets can be used. Under ordinary operating conditions, valving in manifolds 14 and 16 allows only one input or output line to be open at a time. In some embodiments, inlet and outlet manifolds 14 and 16 are controlled electronically, as discussed in greater detail below with respect to controller 40. In other embodiments, inlet and outlet manifolds 14 and 16 can be actuated manually. Some embodiments of spray system 10 can allow for both electronic and manual valve actuation of inlet and outlet manifolds 14 and 16.

In the depicted embodiment, inlet manifolds 14 selectively connect pumps 12 to primary fluid sources 22 and 24 via fluid lines $F_1$ and $F_2$, respectively, and to solvent sources 26 via solvent lines S. Primary fluid sources 22*a* and 24*a* can, for example, be first and second paints P1 and P2, while primary fluid sources 22*b* and 24*b* can, for example, be first and second catalyst fluids C1 and C2. Solvent sources 26*a* and 26*b* can draw upon a common reservoir of solvent material, or can use different solvent materials.

In the depicted embodiment, outlet manifolds 16 similarly selectively connect pumps 12 to sprayers 28 and 30 via spray lines $S_1$ and $S_2$, and to waste fluid dump 31 via waste lines W. Waste fluid dump 31 accepts waste paint, catalyst, and solvent flushed from spray system 10 (e.g. when switching from first paint P1 and first catalyst fluid C1 to second paint P2 and second catalyst fluid C2). Sprayers 28 and 30 each accept spray lines from both A-side and B-side outlet manifolds 16. Sprayer 28, for example, accepts spray line $S_{1a}$ from A-side outlet manifold $\mathbf{16}_a$ and spray line $S_{1b}$ from B-side outlet manifold $\mathbf{16}_b$. Although only two sprayers 28 and 30 are depicted in FIG. 1, any number of separate sprayers can be used. Each sprayer can be dedicated to a single spray fluid combination (e.g. of paint and catalyst), to avoid mixture or fouling of different fluids. Accordingly, embodiments with additional fluid sources advantageously include additional sprayers, as well. Alternatively, sprayers need not be devoted to particular fluid combinations, but can be used sequentially for multiple different fluid combinations, if washed between spray sessions with different fluids. Sprayers 28 and 30 can, for example, be user-triggered spray guns or machine-actuated automatic sprayers.

In some embodiments, primary fluid sources 22 and 24 and solvent sources 26 are pre-pressurized sources capable of supplying at least 50% of output pressure of pumps 12. Pre-pressurized sources alleviate pumping load on motorized actuators 18, such that pumps 12 need only supply less than 50% (per the previously stated case) of output pressure. Sources 22, 24, and 26 can include dedicated pumps for pre-pressurizing fluids.

In the depicted embodiment, pumps 12 are metered linear pumps with dosing cylinders 32 that carry displacement rods 34. Displacement rods 34 are driven by motorized actuators 18, and both situate and drive plungers 36. In some embodiments, dosing cylinders 32, displacements rods 34, and plungers 36 may be balanced in working surface area so as to receive equal pressure from pre-pressurized sources (e.g. 22, 24) on up- and down-strokes.

The motor speed of motorized actuators 18 is variable, and determines the displacement of pumps 12. Displacement rods 34 extend into rod reservoirs 38, which can in some embodiments be flooded with lubricant from lubricant system 20. Pumps 12 each have inlet and outlet valves that actuate between up- and down-strokes of displacement rods 34 to direct fluid above or below plungers 36.

Spray system 10 is controlled by controller 40. Controller 40 is a computing device such as a microprocessor or collection of microprocessors with associated memory and local operator interface 42. Local operator interface 42 is a user interface device with, e.g. a screen, keys, dials, and/or gauges. In some embodiments of the present invention, local operator interface 42 can be a wired or wireless connection for a user operated tablet or computer. In other embodiments, local operator interface 42 can be an integrated interface configured to accept direct user input and provide diagnostic and operational data directly to a user. Local operator interface 42 can, for example, enable a user to input target ratios of A- and B-side fluid flow for each combination of A- and B-side fluids, and target output pressure. Local operator interface 42 can also provide users with diagnostic information including but not limited to failure identifications (e.g. for clogging or leakage), spray statistics (e.g. fluid volume sprayed or remaining), and status indications (e.g. "cleaning," "spraying," or "offline"). In some embodiments, controller 40 may include a database of known or previous configurations (e.g. target ratios and/or pressures for particular materials), such that a user at local operator interface 42 need only select a configuration from several options.

Controller 40 controls motorized actuators 18 via motor speed control signals $c_s$ and controls pump valving of pumps 12 via pump valve control signals $c_{PV}$. Controller 40 synchronizes valve actuation of pumps 12 with pump changeover to minimize downtime as plungers 36 reaches the top or bottom of their travel distances within dosing cylinder 32. In some embodiments, controller 40 may also control valving of inlet manifolds 14 and outlet manifolds 16 via inlet valve control signals $c_{IV}$ and outlet valve control signals $c_{OV}$, respectively. Controller 40 receives sensed pressure values $P_a$ and $P_b$ from pressure sensors 44*a* and 44*b*, respectively, and receives encoder feedback data $f_a$ and $f_b$ reflecting motor states from motorized actuators 18*a* and 18*b*, respectively.

Pumping system 10 provides substantially uniform and continuous spray pressure through pump changeovers at specified pressures and material ratios. Pumping system 10 enables clean and efficient pumping and fluid switching without risk of fluid contamination, and without need for lengthy downtimes or large volume use of washing solvents.

Figure 2A:
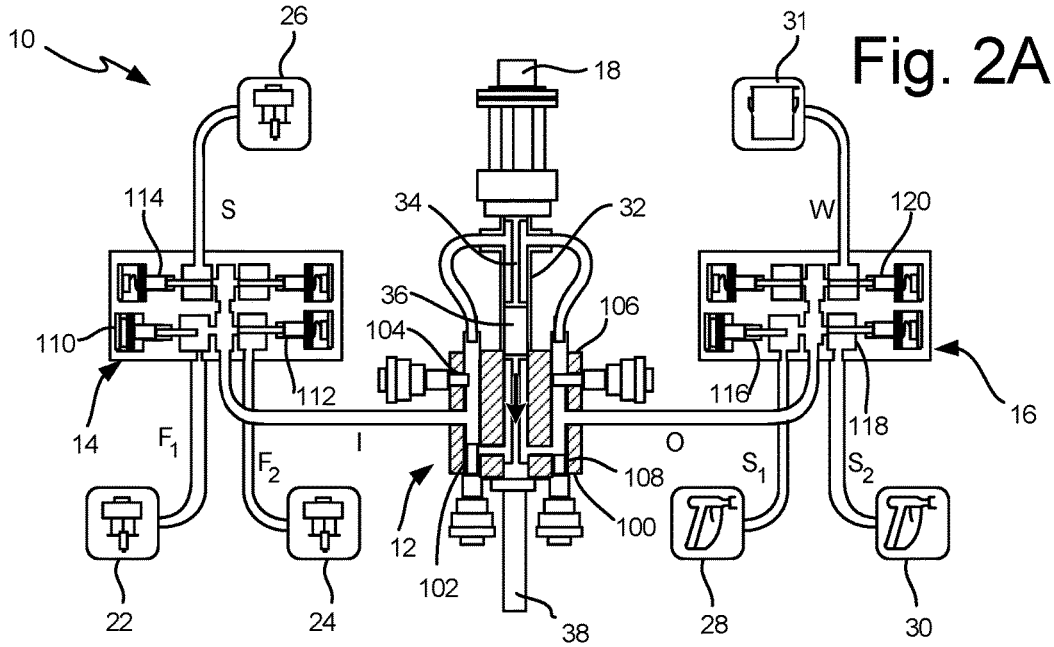
FIGS. 2*a* and 2*b* are schematic views of operating states of a pump of the spray system of FIG. 1.
Figure 2B:
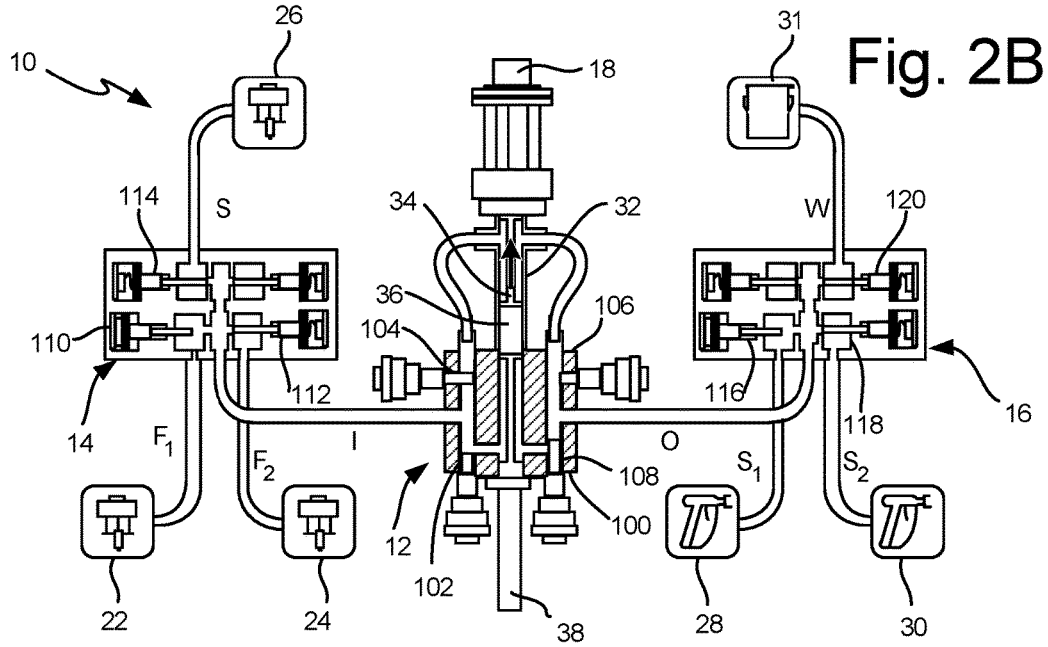

FIGS. 2*a* and 2*b* are schematic views of spray system 10 focusing on pump 12 (i.e. 12*a* or 12*b*, equivalently). FIGS. 2*a* and 2*b* illustrate operating states of pump 12, with FIG. 2*a* depicting pump 12 in a down-stroke valve state and FIG. 2*b* depicting pump 12 in an up-stroke valve state. FIGS. 2*a* and 2*b* depict inlet manifold 14, outlet manifold 16, motorized actuator 18, primary fluid sources 22 and 24, solvent source 26, sprayers 28 and 30, waste fluid dump 31, dosing cylinder 32, displacement rod 34, plunger 36, and various connecting fluid lines as described previously with respect to FIG. 1. FIGS. 2*a* and 2*b* further depict body 100 of pump 12, "up" and "down" inlet valves 102 and 104, respectively, "up" and "down" outlet valves 106 and 108, respectively, inlet manifold valves 110, 112, and 114, and outlet manifold valves 116, 118, and 120.

FIGS. 2*a* and 2*b* depict a state of spray system 10 in which inlet manifold 14 has engaged primary fluid source 22 and outlet manifold 16 has engaged sprayer 28. Accordingly, inlet manifold valve 110 to fluid line $F_1$ is open, and inlet manifold valves 112 and 114 to fluid line $F_2$ and solvent line S, respectively, are closed. Similarly, outlet manifold valve 116 to sprayer 28 is open, while outlet manifold valves 118 and 120 to sprayer 30 and waste fluid dump 31, respectively, are closed. Valves 110, 112, 114, 116, 118, and 120 are depicted as pin valves, but any pressure-capable valves may equivalently be used. As noted with respect to FIG. 1, these valves may be actuated by controller 40, or directly by a user. Only one inlet manifold valve (110, 112, 114) and one outlet manifold valve (116, 118, 120) will ordinarily be open at any time.

Inlet valves 102 and 104 and outlet valves 106 and 108 of pump 12 are actuated by controller 40 in coordination with up- and down-strokes of displacement rod 34 and plunger 36. "Up" inlet and outlet valves 102 and 106, respectively, are open and "down" inlet and outlet valves 104 and 108, respectively, are closed while displacement rod 34 and plunger 36 travel upward (FIG. 2*b*). "Up" inlet and outlet valves 102 and 106, respectively, are closed and "down" inlet and outlet valves 104 and 108, respectively, are open while displacement rod 34 and plunger 36 travel downward (FIG. 2*a*). Controller 40 actuates these valves between pump strokes so as to minimize pump downtime during pump changeover. Lengthy changeover times can otherwise reduce output pressures and introduce undesirable pressure variation. The reciprocation of plunger 36 draws fluid from primary fluid source 22 into pump body 100 from inlet I, and forces fluid from pump body 100 towards sprayer 28 through outlet O. As mentioned above with respect to FIG. 1, pump 12 can be balanced to receive equal pressure assist from pre-pressurized fluid sources (i.e. 22, 24, 26). Balanced embodiments of pump 12 have displacement rods 34 and plungers 36 with equal up-stroke and down-stroke working surface area.

Figure 3:
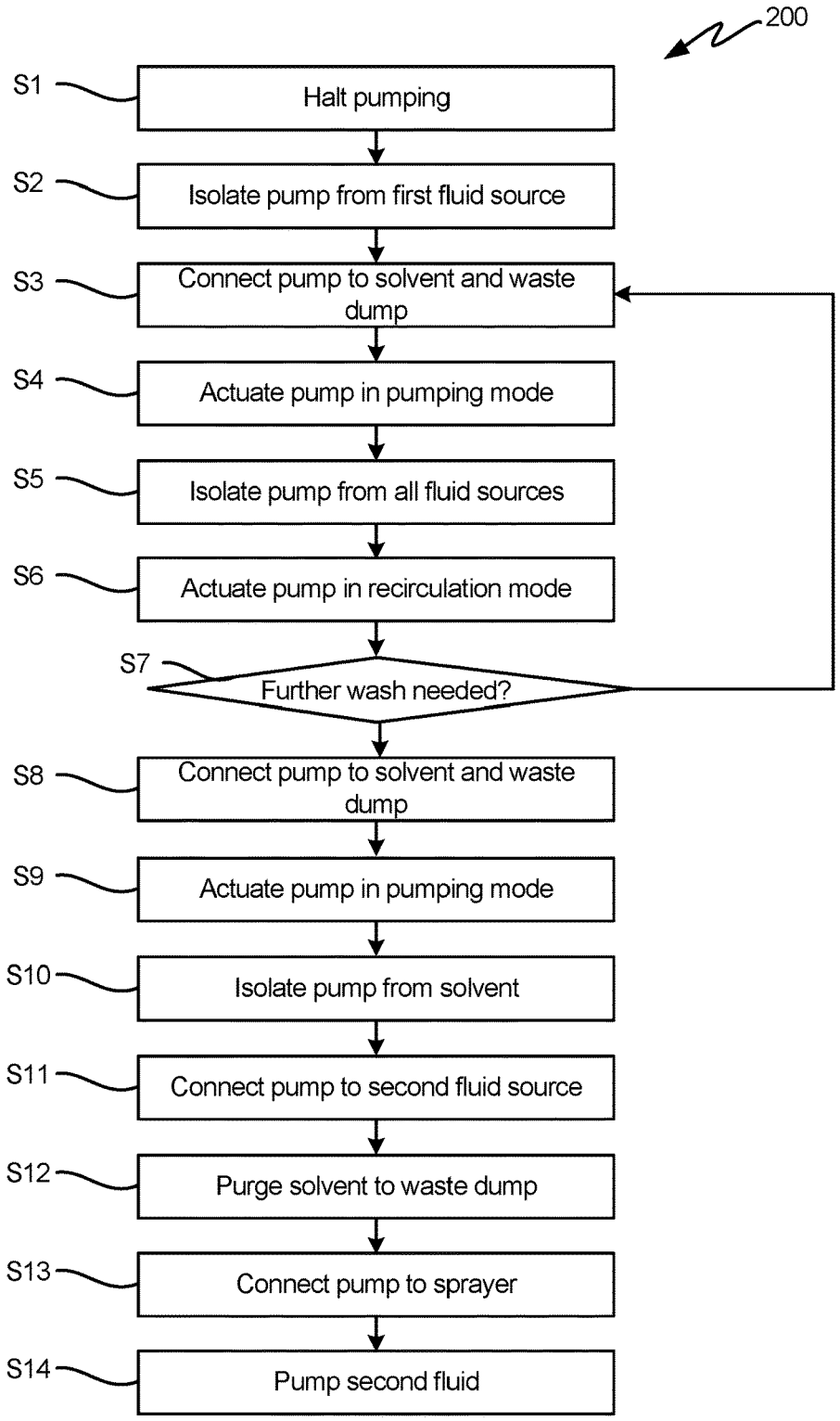
FIG. 3 is a method flowchart illustrating a wash sequence for the pump of FIG. 1.

FIG. 3 is a method flowchart illustrating method 200. Method 200 illustrates a material switching process and washing sequence whereby pump 12 transitions from pumping a first primary fluid to a second (e.g. from fluid source 22 to fluid source 24). As discussed above with respect to FIGS. 1, 2*a*, and 2*b*, each fluid source has a dedicated fluid line to inlet manifold 14, and may use either a shared or dedicated sprayer 28 or 30 with spray line $S_1$ or $S_2$. Dedicated fluid lines avoid cross-contamination of pumping fluids between inlet manifold 14 and outlet manifold 16, but inlet line I, pump 12, and outlet line O are shared in common between all materials processed by spray system 10. Embodiments of spray system 10 that utilize the same sprayer for multiple fluid types can wash or sprayers between spray sessions with different materials. Method 200 allows system 10 to avoid contamination of these sections by automatically washing out inlet manifold 14, pump 12, and outlet manifold 16 with solvent material as a part of switching between primary fluids (e.g. between paints or catalysts).

At the start of a pumping material switch, controller 40 commands pump 12 to halt pumping. (Step S1). Controller 40 then transmits control signals $C_{IV}$ and $C_{OV}$ commanding inlet manifold 14 and outlet manifold 16 to isolate pump 12 from primary fluid sources by closing valves 110, 112, 116, and 118. (Step S2). Next, controller 40 commands inlet manifold 14 to open valve 114, and outlet manifold 16 to open valve 120, thereby connecting pump 12 to solvent source 26 and waste fluid dump 31. (Step S3).

Previously loaded primary fluid is flushed from inlet manifold 14, inlet line I, pump 12, outlet line O, and outlet manifold 16 by actuating pump 12 in an ordinary pumping mode (described above with respect to FIGS. 2*a* and 2*b*) while fluidly connected to solvent source 26 and waste fluid dump 31. (Step S4). Controller 40 directs pump 12 through a sufficient number of ordinary pumping cycles to force any primary fluid remaining in the fluid out past outlet manifold 16. Waste fluid is expelled into fluid dump 31.

Figure 4:
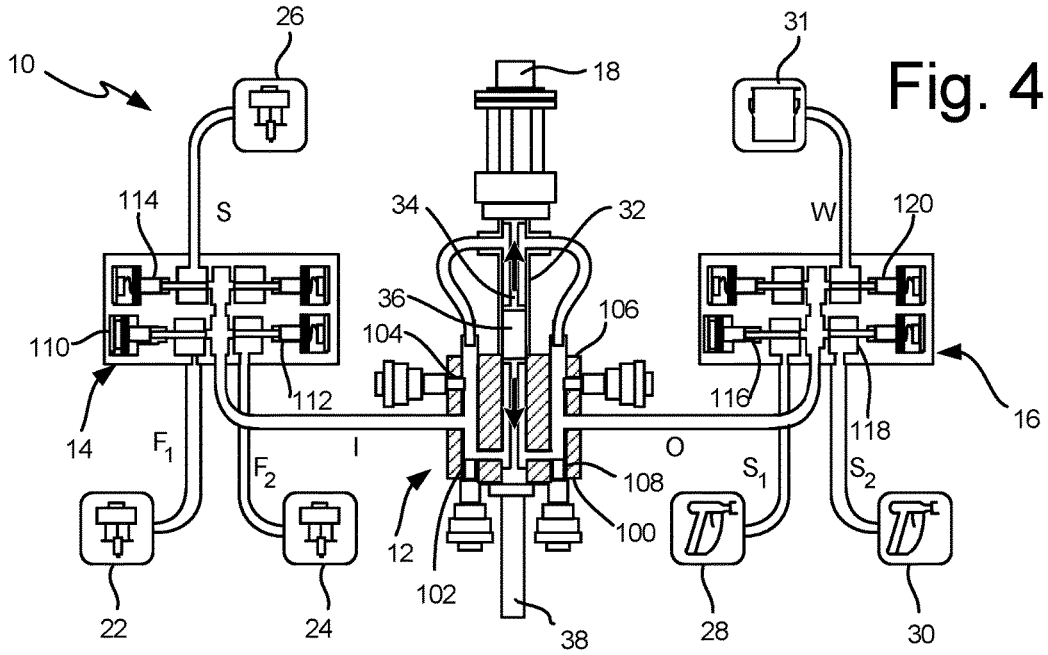
FIG. 4 is a schematic view of a recirculation state of the pump of FIG. 1 during a recirculation mode of the wash sequence of FIG. 3.

Washing is accomplished primarily by recirculating solvent through pump 12. Solvent source 26 can, for example, contain solvents such as alcohols, esters, ketones, aliphatic petroleum naphthas, and aromatic hydrocarbons. Once solvent fills the fluid space from inlet manifold 14 to outlet manifold 16, controller 40 commands inlet manifold 14 and outlet manifold 16 to shut all valves, isolating pump 12 from all fluid sources. (Step S5). In this isolated state, controller 40 then switches pump 12 to a recirculation mode for washing. (Step S6). FIG. 4 is a schematic view of spray system 10 focusing on pump 12 during this recirculation mode. FIG. 4 illustrates all of the same elements as FIGS. 2*a* and 2*b*, with only valve positions of pump 12 and inlet and outlet manifolds 14 and 16 having changed. In the depicted recirculation mode, plunger 36 reciprocates back and forth while all pump valves 102, 104, 106, and 108 are held open, and all valves of inlet and outlet manifolds 14 and 16 are held closed. This pump configurations causes reciprocation of plunger 36 to turbulently circulate solvent through pump 12, scouring away any accumulated primary fluid. Depending on the particular primary fluid material, more or fewer cycles of recirculation may be needed. In general, materials with higher viscosity or greater fouling potential will require more cleaning cycles to flush.

For some applications, multiple wash cycles may be needed to thoroughly clean pump 12 and associated fluid lines. Controller 40 can, for example, command spray system 10 through a plurality of wash cycles by repeating steps S3 through S6 until further washing is no longer necessary. (Step S7). Once a desired number of wash cycles have been completed, dirty solvent material is purged. Controller 40 commands inlet manifold 14 and outlet manifold 16 to reconnect pump 12 to solvent source 26 and waste fluid dump 31, respectively. (Step S8). Dirty solvent fluid is purged from pump 12 by actuating pump 12 in standard pumping mode with clean solvent. (Step S9).

Figure 5:
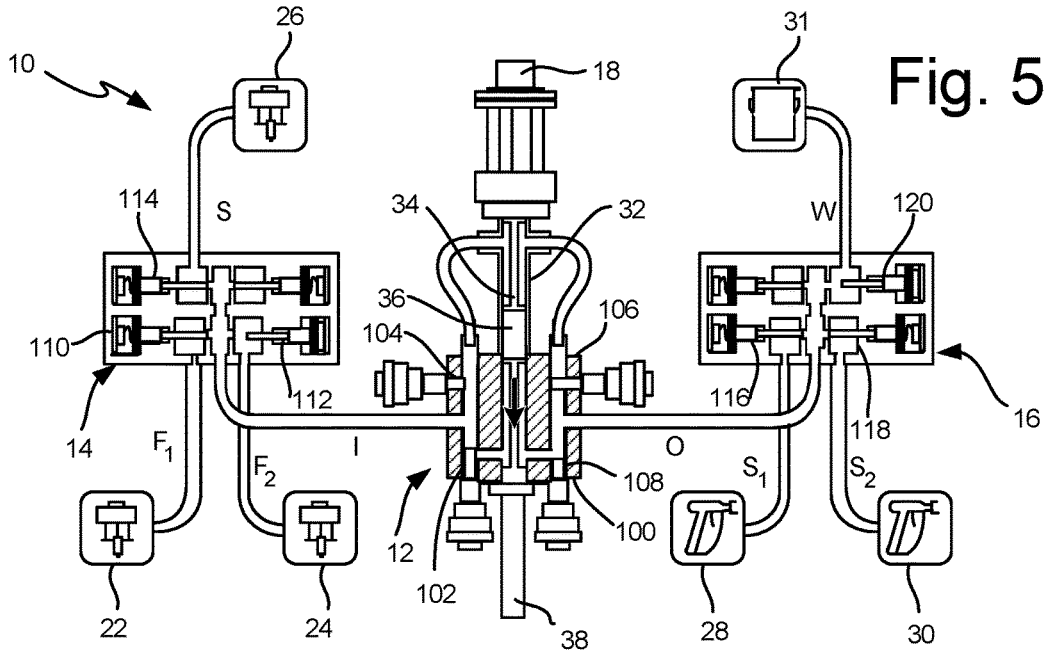
FIG. 5 is a schematic view of a purge state of the pump of FIG. 1 during a purge mode of the wash sequence of FIG. 3.

Next, solvent material is purged altogether from pump 12 via connecting pump 12 to a second primary fluid source (e.g. 24 in the depicted embodiment), and actuating pump 12 through a purge mode. Controller 40 commands inlet manifold 14 to isolate pump 12 from solvent source 26 (Step S10), and connects pump 12 to a second primary fluid source (e.g. 24; Step S11). Controller 40 then controls motorized actuator 18 and pump 12 through several cycles of ordinary pumping in a purge mode. (Step S12). FIG. 5 is a schematic view of spray system 10 during this purge mode. FIG. 5 illustrates all the same elements as FIGS. 2*a*, 2*b*, and 4, with only the valve positions of pump 12 and inlet and outlet manifolds 14 and 16 having changed. In particular, inlet manifold 14 connects pump 12 to a second primary fluid source, while outlet manifold 16 connects pump 12 to waste fluid dump 31. Valves of pump 12 are actuated synchronously with the reciprocation of plunger 36, as described above with respect to FIGS. 2*a* and 2*b*. This purge mode serves to expel solvent from pump 12 into waste fluid dump 31. Once the last of this solvent has been pumped past outlet manifold 16, controller 40 commands outlet manifold 16 to connect pump 12 to a sprayer (e.g. sprayer 28 or 30, in the depicted embodiment). (Step S13). From this point, spray operation can resume as normal, pumping the new primary fluid. (Step S14). As noted above with respect to FIG. 3, some embodiments of spray system 10 may utilize separate sprayers for each primary fluid, while others may use the same sprayer for multiple fluids, cleaning the sprayer between uses with different primary fluids.

Figure 6:
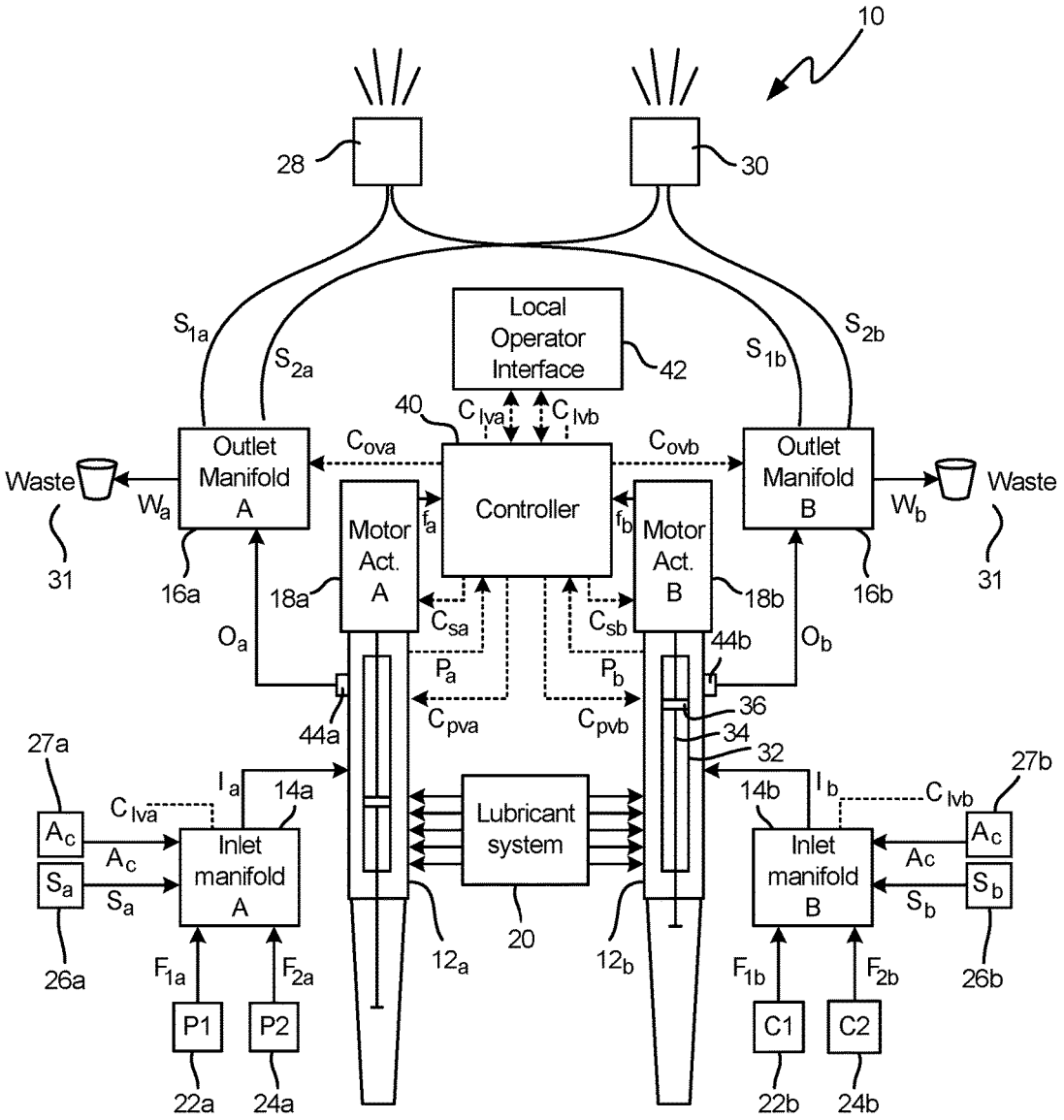
FIG. 6 is a schematic view of an alternative spray system.
Figure 7:
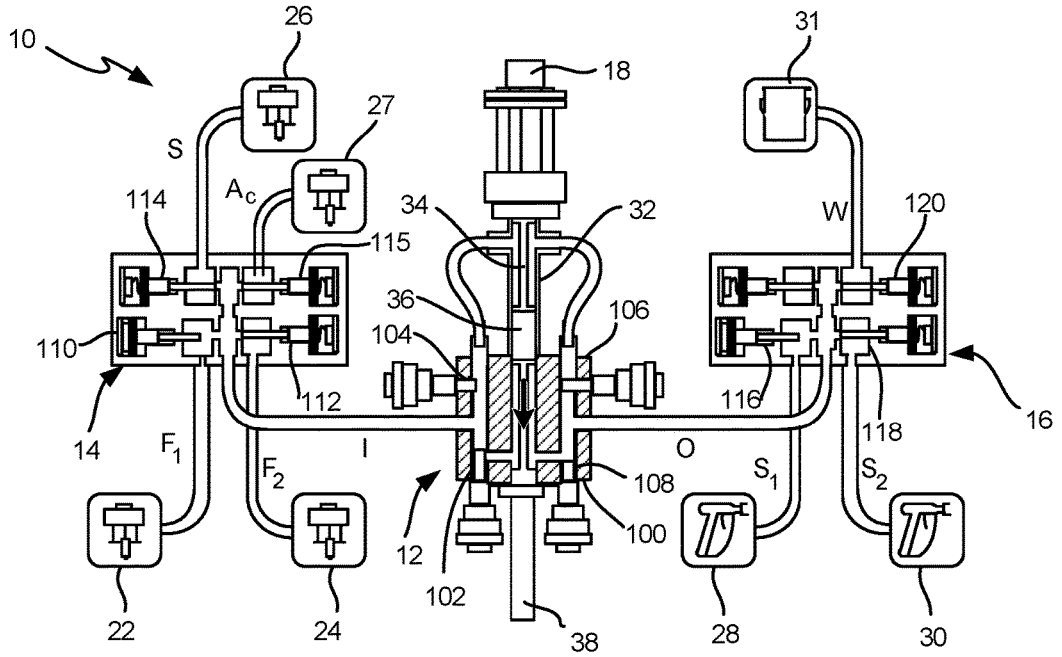
FIG. 7 is a schematic view of an operating state of the spray system of FIG. 6.

FIG. 6 is a schematic diagram of alternative spray system 10'. Spray system 10' is substantially similar to spray system 10, however, spray system 10' includes compressed air sources 27 selectively connected to pumps 12 via compressed air lines $A_C$ and inlet manifolds 14. Compressed air sources 27 can be a source of clean, dry air, such as filtered, vapor-separated air regulated to 120 psi or less. FIG. 7 is a schematic view of spray system 10' focusing on pump 12. As can be seen in FIG. 5, spray system 10' is substantially similar to the embodiment shown in FIGS. 2*a* and 2*b*, except that additional valve 15 is shown in communication with compressed air source 27 via line $A_C$.

Figure 8:
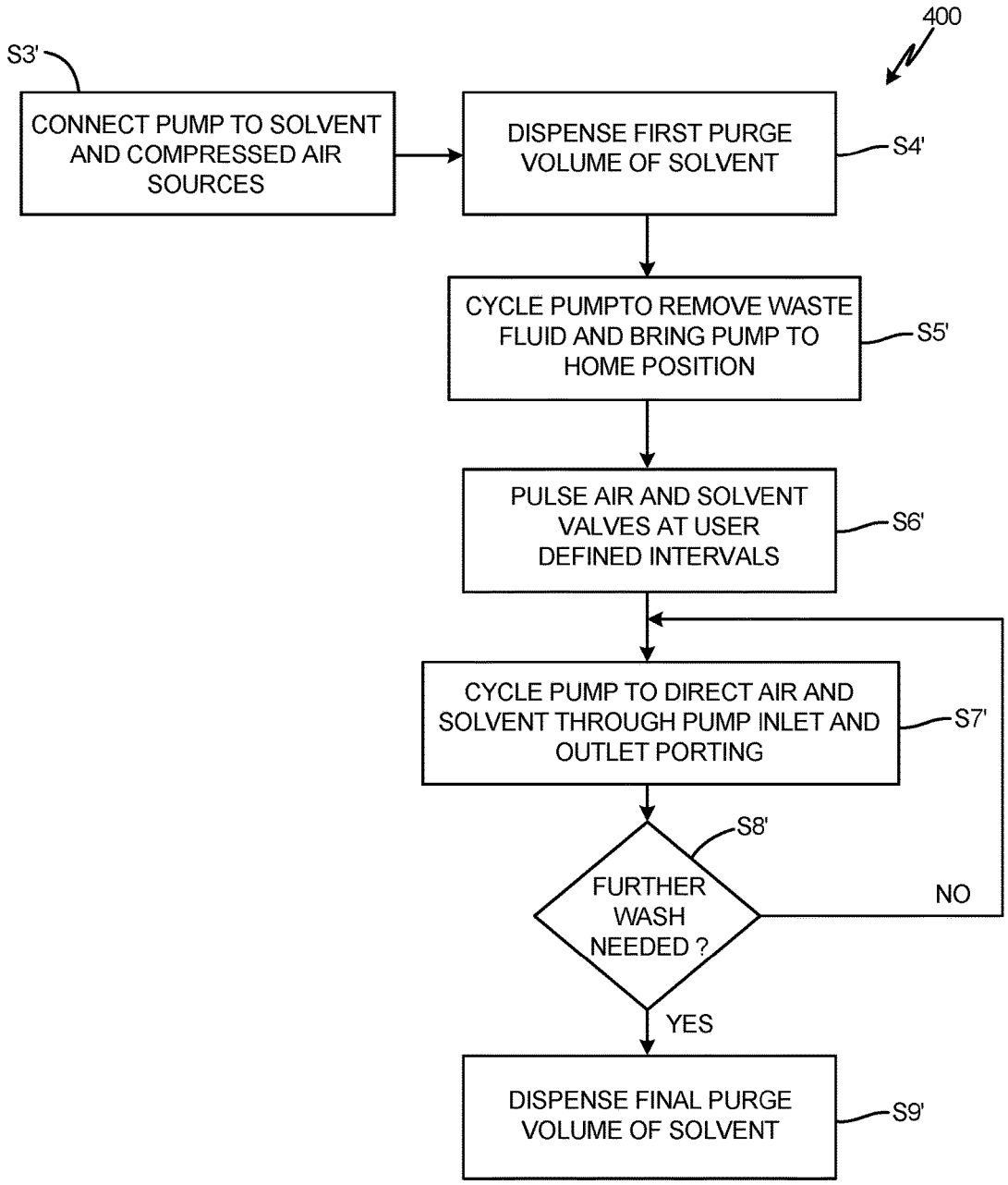
FIG. 8 is a method flow chart illustrating a wash sequence for the pump of FIG. 6.

FIG. 8 is a method flowchart illustrating method 400. As the material switching sequence performed by system 10' is substantially similar to that depicted in method 200, method 400 specifically illustrates the flush/washing sequence performed by system 10'. Controller 40 commands inlet manifold 14 to open valves 114 and 115, and outlet manifold to open valve 120, thereby connecting pump 12 to solvent source 26, compressed air source 27, and waste fluid dump 31. (Step S3'). A first purge volume of solvent is then dispensed by solvent source 26. (Step S4'). Pump 12 cycles for a predetermined number of strokes to remove any remaining primary fluid. The waste fluid is expelled into fluid dump 31. Pump 12 is then placed at a home position. (Step S5').

Washing is accomplished by operating a timed flow mode in which compressed air and solvent are alternatingly introduced into pump 12. More specifically, controller 40 commands valves 114 and 115 to pulse at defined intervals. (Step S6'). The air-solvent mixture flows through all inlet and outlet fluid porting of pump 12 to fluid dump 31 (Step S7') to ensure thorough cleaning of all fluid passages, and controller 40 can continue to command pump 12 to cycle until no further washing is needed. (Step S8'). A final purge volume of solvent is then dispensed by solvent source 26, and pump 12 cycles while the air-solvent mixture is expelled into fluid dump 31. (Step 9').

Although methods 200 and 400 have been described as methods for washing pump 12 and attached fluid lines when switching from one pumped material to another, methods 200 and 400 can also be adapted as cleaning methods wherein the same primary fluid is pumped both before and after cleaning. In this application, methods 200 and 400 are useful as a means of removing any material buildup within pump 12 that might give rise to clogging or congestion.

As used in material changes, method 200 allows pump 12 to be efficiently and thoroughly washed when switching between applied fluid materials, without the need for time consuming disconnection, reconnection, or manual washing of fluid handling components. Methods 200 and 400 thoroughly purge pump 12 of a first material before loading and pumping a second material, while consuming only limited washing solvent. By using a turbulent flow of air and solvent, method 400 specifically can provide a quick but thorough cleansing of pump 12.

Discussion of Possible Embodiments

The following are non-exclusive descriptions of possible embodiments of the present invention.

A method for a system having a plurality of primary fluid sources and a fluid output with a common pump includes halting pumping of a first fluid, isolating the common pump from the fluid output and the primary fluid sources, connecting an inlet of the common pump to a solvent source and a compressed air source, and an outlet of the common pump to a waste fluid dump, filling the common pump with a first purge volume of solvent, cycling the common pump in a flush mode, operating the common pump in a timed flow mode, and connecting an inlet of the common pump to a second primary fluid source, and an outlet of the common pump to the output line, and starting pumping of a second fluid from the second primary fluid source through the output line.

The method of the preceding paragraph can optionally include, additionally and/or alternatively, any one or more of the following features, configurations and/or additional components:

A further embodiment of the foregoing method, wherein the common pump is a double-action linear pump with a reciprocating plunger and "up" and "down" inlet and outlet valves.

A further embodiment of the foregoing method, wherein isolating the common pump from the output line and the primary fluid sources comprises closing valves connecting the output line and the solvent source.

A further embodiment of the foregoing method, wherein a valved inlet manifold selectively couples the inlet of the common to pump the first and second fluid sources, the solvent source, and the compressed air source, individually.

A further embodiment of the foregoing method, wherein operating the common pump in the timed flow mode comprises alternatingly opening a solvent source inlet valve for a first length of time and a compressed air source inlet valve for a second length of time.

A further embodiment of the foregoing method further comprises filling the common pump with a second purge volume of the washing solvent and cycling the pump to flush waste air and solvent from the pump.

A further embodiment of the foregoing method, wherein connecting an outlet of the common pump to a waste fluid dump comprises closing valves connecting the common pump to the output line and opening valves connecting the common pump the waste fluid dump.

A further embodiment of the foregoing method, wherein a valved outlet manifold selectively couples the outlet of the common pump to the outlet line and the waste fluid dump, individually.

A further embodiment of the foregoing method, wherein the washing solvent is an alcohol, ester, ketone, aliphatic petroleum naphtha, or aromatic hydrocarbon.

A spray system includes a solvent source, a compressed air source, a waste fluid dump, a pump, a controller, valved inlet and outlet manifolds, and first and second fluid sources and sprayers for a first and second spray fluids, respectively. The solvent source supplies a washing solvent and the compressed air source provides an air stream. The pump includes a metered double-action pumping cylinder with a reciprocating plunger, and first and second inlet and outlet valves. The valved inlet manifold selectively couples the pump to the first and second fluid sources, the solvent source, and the compressed air source, while the valved outlet manifold selectively couples the pump to a fluid output and the waste fluid dump. The controller is configured to control the pump to spray the first fluid during a first operational state and the second fluid in a second operational state, and to transition from the first operational state to the second operational state via an intermediate washing process. In the intermediate washing process, the valved inlet manifold connects the pump to the solvent source and the compressed air source, and the valved outlet manifold connects the pump to the waste fluid dump, and the pump is actuated first in a pumping mode to flush the first fluid from the pump, then in a timed flow mode to direct washing solvent and compressed air through the pump.

The spray system of the preceding paragraph can optionally include, additionally and/or alternatively, any one or more of the following features, configurations and/or additional components:

A further embodiment of the foregoing spray system, wherein the first operational state comprises the valved inlet manifold connecting the pump to the first fluid source, the valved outlet manifold connecting the pump to the first sprayer, and the pump actuating in the pumping mode to pump the first fluid through the sprayer.

A further embodiment of the foregoing spray system, wherein actuating the common pump in a pumping mode comprises alternatingly executing a down-stroke of the reciprocating plunger with the first inlet and outlet valves open and the second inlet and outlet valves closed, and an up-stroke of the reciprocating plunger with the second inlet and outlet valves open and the first inlet and outlet valves closed.

A further embodiment of the foregoing spray system, wherein actuating the common pump in a timed flow mode comprises alternatingly opening a solvent source inlet valve for a first length of time and a compressed air source inlet valve for a second length of time.

A further embodiment of the foregoing spray system, wherein the solvent is an alcohol, ester, ketone, aliphatic petroleum naphtha, or aromatic hydrocarbon.

A further embodiment of the foregoing spray system, wherein valving of the pump, the valved inlet manifold, and the valved outlet manifold are all controlled by the controller.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fluid change method for a multi-fluid spray system having a plurality of primary fluid sources with an output line and a common pump, the method comprising:

halting pumping of a first fluid from a first primary fluid source through the output line;

isolating the common pump from the output line and the primary fluid sources;

connecting an inlet of the common pump to a solvent source and a compressed air source, and an outlet of the common pump to a waste fluid dump;

filling the common pump with a first purge volume of washing solvent from the solvent source;

cycling the common pump in a flush mode to flush dirty solvent from the common pump;

operating the common pump in a timed flow mode to fill the common pump with an air stream from the compressed air source and washing solvent in an alternating fashion;

connecting an inlet of the common pump to a second primary fluid source, and actuating the pump in the pumping mode;

connecting an outlet of the common pump to the output line; and starting pumping of a second fluid from the second primary fluid source through the output line.

2. The method of claim 1, wherein the common pump is a double-action linear pump with a reciprocating plunger and "up" and "down" inlet and outlet valves.

3. The method of claim 1, wherein isolating the common pump from the output line and the primary fluid sources comprises closing valves connecting the output line and the solvent source.

4. The method of claim 3, wherein a valved inlet manifold selectively couples the inlet of the common to pump the first and second fluid sources, the solvent source, and the compressed air source, individually.

5. The method of claim 4, wherein operating the common pump in the timed flow mode comprises alternatingly opening a solvent source inlet valve for a first length of time and a compressed air source inlet valve for a second length of time.

6. The method of claim 1 and further comprising: filling the common pump with a second purge volume of the washing solvent and cycling the pump to flush waste air and solvent from the pump.

7. The method of claim 1, wherein connecting an outlet of the common pump to a waste fluid dump comprises closing valves connecting the common pump to the output line and opening valves connecting the common pump the waste fluid dump.

8. The method of claim 7, wherein a valved outlet manifold selectively couples the outlet of the common pump to the outlet line and the waste fluid dump, individually.

9. The method of claim 1, wherein the washing solvent is an alcohol, ester, ketone, aliphatic petroleum naphtha, or aromatic hydrocarbon.

10. A spray system comprising:

a first fluid source and a first sprayer for a spraying first spray fluid;

a second fluid source and a second sprayer for spraying a second spray fluid;

a solvent source for providing a washing solvent;

a compressed air source for providing an air stream;

a waste fluid dump;

a pump comprising:

a metered double-action pumping cylinder with a reciprocating plunger;

first and second inlet valves; and first and second outlet valves;

a valved inlet manifold configured to selectively couple the pump to the first and second fluid sources, the solvent source, and the compressed air source;

a valved outlet manifold configured to selectively couple the pump to the first and second sprayers and the waste fluid dump; and a controller configured to control the pump to spray the first fluid during a first operational state and the second fluid in a second operational state; and to transition from the first operational state to the second operational state via an intermediate washing process wherein during the intermediate washing process the valved inlet manifold connects the pump to the solvent source and the compressed air source, the valved outlet manifold connects the pump to the waste fluid dump, and the pump is actuated first in a pumping mode to flush the first fluid from the pump, then in a timed flow mode mode to direct washing solvent and compressed air through the pump, and then a flush mode to flush waste air and solvent from the pump.

11. The spray system of claim 10, wherein the first operational state comprises:

the valved inlet manifold connecting the pump to the first fluid source;

the valved outlet manifold connecting the pump to the first sprayer; and the pump actuating in the pumping mode to pump the first fluid through the sprayer.

12. The spray system of claim 10, wherein actuating the common pump in a pumping mode comprises:

alternatingly executing a down-stroke of the reciprocating plunger with the first inlet and outlet valves open and the second inlet and outlet valves closed and an up-stroke of the reciprocating plunger with the second inlet and outlet valves open and the first inlet and outlet valves closed.

13. The spray system of claim 10, wherein actuating the common pump in a timed flow mode comprises alternatingly opening a solvent source inlet valve for a first length of time and a compressed air source inlet valve for a second length of time.

14. The spray system of claim 10, wherein the solvent is an alcohol, ester, ketone, aliphatic petroleum naphtha, or aromatic hydrocarbon.

15. The spray system of claim 10, wherein valving of the pump, the valved inlet manifold, and the valved outlet manifold are all controlled by the controller.

* * * * *